US012234562B2

(12) United States Patent
Wildlock et al.

(10) Patent No.: US 12,234,562 B2
(45) Date of Patent: Feb. 25, 2025

(54) SELECTIVE CATHODE FOR USE IN ELECTROLYTIC CHLORATE PROCESS

(71) Applicant: NOURYON CHEMICALS INTERNATIONAL B.V., Arnhem (NL)

(72) Inventors: Mats Patrik Wildlock, Kungälv (SE); Nina Natalija Helene Simic, Torslanda (SE); Ann Maria Cornell, Lidingö (SE); Balázs Endrödi, Szeged (HU); Aleksandra Lindberg, Stockholm (SE)

(73) Assignee: NOURYON CHEMICALS INTERNATIONAL B.V., Arnhem (NL)

( * ) Notice: Subject to any disclaimer, the term of this patent is extended or adjusted under 35 U.S.C. 154(b) by 893 days.

(21) Appl. No.: 17/250,961

(22) PCT Filed: Oct. 1, 2019

(86) PCT No.: PCT/EP2019/076664
§ 371 (c)(1),
(2) Date: Apr. 2, 2021

(87) PCT Pub. No.: WO2020/070172
PCT Pub. Date: Apr. 9, 2020

(65) Prior Publication Data

US 2021/0381118 A1 Dec. 9, 2021

(30) Foreign Application Priority Data

Oct. 2, 2018 (EP) ..... 18198098

(51) Int. Cl.

| | |
|---|---|
| ***C25B 9/00*** | (2021.01) |
| ***C25B 1/26*** | (2006.01) |
| ***C25B 11/00*** | (2021.01) |
| ***C25B 11/053*** | (2021.01) |
| ***C25B 11/057*** | (2021.01) |
| ***C25B 11/077*** | (2021.01) |
| *C25B 1/04* | (2021.01) |

(52) U.S. Cl.
CPC ..... *C25B 11/053* (2021.01); *C25B 1/265* (2013.01); *C25B 11/057* (2021.01); *C25B 11/077* (2021.01); *C25B 1/04* (2013.01)

(58) Field of Classification Search
CPC ... C25B 11/053; C25B 11/057; C25B 11/077; C25B 1/265; C25B 1/04; C25B 9/00; C25B 11/00
See application file for complete search history.

(56) References Cited

U.S. PATENT DOCUMENTS

| | | | | |
|---|---|---|---|---|
| 5,622,613 | A | 4/1997 | Arimoto et al. | |
| 2012/0305407 | A1 | 12/2012 | Anderson et al. | |
| 2013/0292261 | A1* | 11/2013 | Hedenstedt | C25B 1/14 205/503 |
| 2018/0265996 | A1 | 9/2018 | Rosvall et al. | |

FOREIGN PATENT DOCUMENTS

| | | | |
|---|---|---|---|
| EP | 0298055 | A1 | 1/1989 |
| EP | 3023517 | A1 | 5/2016 |
| EP | 2430214 | B1 | 7/2018 |
| GB | 850378 | A | 10/1960 |
| JP | H07252683 | A | 10/1995 |
| WO | 2009063031 | A2 | 5/2009 |
| WO | 2010130546 | A1 | 11/2010 |
| WO | 2017050867 | A1 | 3/2017 |
| WO | 2017050873 | A1 | 3/2017 |

OTHER PUBLICATIONS

EPO, European Extended Search Report issued in EP Application No. 18198098.8, mailed Feb. 18, 2019.
EPO, International Search Report issued in International Application No. PCT/EP2019/076664, mailed Dec. 11, 2019.
Barsoum, M.W., et al. "The Max Phases: Unique New Carbide and Nitride Materials", American Scientist, 2001, pp. 334-343, vol. 89.
Book : A Handbook of catalysts; Author: Zhu Hongfa; Publisher: Golden Shield Press; Date: Aug. 31, 2008; pp. 7-9.
Balazs Endrodi et al, Towards sustainable chlorate production: The effect of permangamate addition on current effiency, Journal, Feb. 18, 2018, p. 529-537, Elsevier.

* cited by examiner

*Primary Examiner* — Zulmariam Mendez
(74) *Attorney, Agent, or Firm* — Lorenz & Kopf, LLP

(57) ABSTRACT

The present disclosure relates to a process for the production of alkali metal chlorate in a single compartment electrolytic cell, which avoids the need for addition of sodium dichromate to the process, in which unwanted side-reactions are reduced by using a cathode having an electrocatalytic top layer on a substrate that optionally also has one or more intermediate layers. The top electrocatalytic layer comprises an oxide of manganese and/or cerium.

20 Claims, 2 Drawing Sheets

SELECTIVE CATHODE FOR USE IN ELECTROLYTIC CHLORATE PROCESS

CROSS-REFERENCE TO RELATED APPLICATION

This application is a U.S. National-Stage entry under 35 U.S.C. § 371 based on International Application No. PCT/EP2019/076664, filed Oct. 1, 2019 which was published under PCT Article 21(2) and which claims priority to European Application No. 18198098.8, filed Oct. 2, 2018, which are all hereby incorporated in their entirety by reference.

TECHNICAL FIELD

The present disclosure relates to an electrolytic chlorate process which employs a cathode comprising a conductive electrode substrate and an electrocatalytic layer in a non-divided electrolytic cell, with an electrolyte solution containing alkali metal chloride.

BACKGROUND

The electrolytic production of alkali metal chlorate, and especially sodium chlorate, is well known. Alkali metal chlorate is an important chemical, particularly in the pulp and paper industry as a raw material for the production of chlorine dioxide that is widely used for bleaching. Conventionally, it is produced by electrolysis of alkali metal chlorides in non-divided electrolytic cells.

A highly concentrated brine solution with sodium chlorate is subject to electrolysis and a series of electrochemical and chemical reactions lead to the formation of NaClO3. At the cathode, hydrogen is released while at the anode chlorine gas is produced according to equation (1) and (2).

$$2H_2O+2e^- \rightarrow 2OH^-+H_2 \quad (1)$$

$$2Cl^- \rightarrow Cl_2+2e^- \quad (2)$$

The produced chlorine hydrolyzes in the brine solution to produce hypochlorous acid and hydrochloric acid (equation 3). The hypochlorous acid, depending on the solution pH form hypochlorite ions (equation 4). These two intermediates, the hypochlorous acid and hypochlorite ion react with each other to form chlorate (equation 5).

$$Cl_2+H_2O \rightarrow HOCl+HCl \quad (3)$$

$$HOCl \rightarrow ClO^-+H^+ \quad (4)$$

$$2HOCl+ClO^- \rightarrow ClO_3^-+2Cl^-+2H^+ \quad (5)$$

Other unwanted reactions can occur which lower the cell efficiency and thus higher amounts of energy will be required coupled with an increased loss in product yield. On the anode oxygen is formed from the oxidation of water or hypochlorite.

Fortunately, this is minimized by using dimensionally stable anodes. However, the unwanted electrochemical reactions happening on the cathode are of major concern. The most important of these are the reduction of chlorate and hypochlorite ions (or hypochlorous acid). Equation 6 and 7 represent the two unwanted reductions of chlorate and hypochlorite ions respectively:

$$ClO_3^-+3H_2O+6e^- \rightarrow Cl^-+6OH^- \quad (6)$$

$$OCl^-+H_2O+2e- \rightarrow Cl^-+2OH^- \quad (7)$$

The unwanted reactions 6 and 7 are minimized by adding sodium dichromate to the electrolyte. The sodium dichromate is reduced on the cathode to form a thin layer of chromium (III) oxide/hydroxide, which results in the previously stated benefits. Another benefit is that hydrogen evolution on the cathode is not hindered by the formed layer. Also the addition of sodium dichromate buffers the electrolyte pH in the range of 5-7, catalyzes chlorate formation and reduces oxygen evolution at the anode.

However, sodium dichromate is a highly toxic chemical substance, both to humans and to the environment.

Coated cathodes for use in chlorate processes have been described in for example U.S. Pat. No. 5,622,613. In this patent cathodes are mentioned that are provided with a film which prevents the reduction of hypochlorite ions by cathode. The film may comprise an organic cation exchanger, an inorganic cation exchanger, or a mixture of these substances may be used. Examples in this patent disclose the use of a fluororesin type cation exchanger with a metal hydroxide (of titanium, zirconium, cerium and iron) dispersed therein.

In EP298055 cathodes for electrolysis are described which are designed to maintain a low hydrogen overpotential. These cathodes comprise a conductive nickel base having provided thereon at least one platinum group metal component selected from the group including a platinum group metal, a platinum group metal oxide, and a platinum group metal hydroxide (hereinafter simply referred to as a platinum group component) and at least one cerium component selected from the group including cerium, cerium oxide, and cerium hydroxide. This patent is concerned with lowering hydrogen overpotential rather than with selectivity.

WO2009063031 is another application concerned with electrodes for chlorate processes. The electrodes described in WO2009063031 are designed to be active and robust, in the sense that they display an acceptable durability and are resistant to hydrogen evolving conditions and oxidizing conditions in the electrolytic cell. Exemplified cathodes had a titanium or activated Maxthal® substrate, provided with coatings comprising Titanium-, Ruthenium- and/or Molybdenum oxide(s). Electrolytes used included sodium dichromate.

In EP2430214 a process for the production of alkali metal chlorate is described aiming at low levels of chromium in the electrolyte (an amount ranging from $0.01\times10^{-6}$ to $100\times10^{-6}$ mol/dm$^3$). The electrolyte further comprises molybdenum, tungsten, vanadium, manganese and/or mixtures thereof in any form in a total amount ranging from $0.1\text{-}10^{-6}$ mol/dm$^3$ to $0.1\times10^{-3}$ mol/dm$^3$. The substrate for the cathodes comprised at least one of titanium, molybdenum, tungsten, titanium suboxide, titanium nitride (TiNX), MAX phase, silicon carbide, titanium carbide, graphite, glassy carbon or mixtures thereof.

Electrodes for use in chlorate processes which are provided with a protective titanium suboxide containing coating are disclosed in WO2017050867 and WO2017050873. WO2017050873 describes an electrode with substrate coated with a layer of titanium suboxide (TiOx) with a total thickness in the range of between 40-200 μm on at least one surface of the electrode substrate, wherein a porosity of the layer of TiOx is below 15%, and an electro-catalytic layer comprising oxides of ruthenium and cerium. The electrode substrate may be titanium. These cathodes are also said to have improved durability in an electrolytic cell used in the chlorate process, where hydrogen penetration at the cathode may affect the longevity and/or mechanical integrity of the electrode.

BRIEF SUMMARY

This disclosure provides a process for producing alkali metal chlorate, comprising introducing an electrolyte solution, free of added chromium, said solution comprising alkali metal chloride to a non-divided electrolytic cell comprising at least one anode and at least one cathode, and electrolyzing the electrolyte solution to produce an electrolyzed solution enriched in chlorate, wherein at least one cathode comprises a conductive electrode substrate which may be coated with one or more intermediate conductive layers, and an electrocatalytic top layer applied onto said substrate or onto intermediate layers, said top layer comprising cerium oxide and/or manganese oxide.

BRIEF DESCRIPTION OF THE FIGURES

The present disclosure will hereinafter be described in conjunction with the following drawing figures, wherein like numerals denote like elements, and.

DETAILED DESCRIPTION

Figure 1:
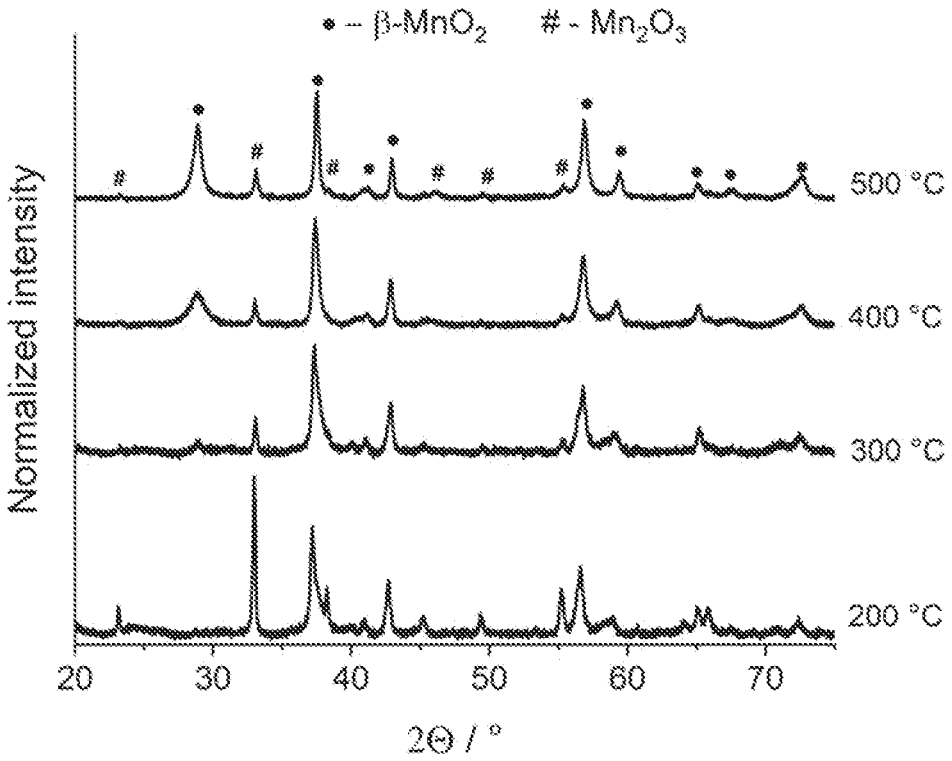
FIG. 1. is an XRD pattern of the MnOx samples, formed from the thermal decomposition of $Mn(NO_3)_2$ at different annealing temperatures.

The following detailed description is merely exemplary in nature and is not intended to limit the disclosure or the application and uses of the disclosure. Furthermore, there is no intention to be bound by any theory presented in the preceding background of the disclosure or the following detailed description.

The present disclosure is concerned with the problem of eliminating the need for the use sodium dichromate in chlorate production by providing selective cathodes that can be used in processes for chlorate production.

The present disclosure provides a process for producing alkali metal chlorate. The process comprising introducing an electrolyte solution, free of added chromium, comprising alkali metal chloride to a non-divided electrolytic cell. The non-divided electrolytic cell comprises at least one anode and at least one cathode. The electrolyte solution is electrolyzed to produce an electrolyzed solution enriched in chlorate. The at least one cathode comprises a conductive electrode substrate, which is optionally coated with one or more intermediate conductive layers, and also an electrocatalytic top layer applied onto said substrate or onto the intermediate layers. The electrocatalytic top layer comprises cerium oxide and/or manganese oxide.

The conductive substrate is exemplified, but not restricted to, titanium, and suitable substrates are known in the art.

The one or more optional intermediate layers can comprise at least one of titanium suboxide, titanium nitride (TiNX), MAX phase, silicon carbide, titanium carbide, graphite, glassy carbon, ruthenium oxide, iridium oxide, cerium oxide or mixtures thereof.

The electrocatalytic top layer is applied onto the substrate or onto the intermediate layers, the top layer comprising at least one of cerium- and manganese oxide.

MAX phase is a known phase, as described in EP2430214. MAX phases are based on formula M(n+1) AXn, where M is a metal of group IIIB, IVB, VB, VIB or VIII of the periodic table of elements or a combination thereof, A is an element of group IIIA, IVA, VA or VIA of the periodic table of elements or a combination thereof, X is carbon, nitrogen or a combination thereof, where n is 1, 2, or 3.

For example, M can be selected from scandium, titanium, vanadium, chromium, zirconium, niobium, molybdenum, hafnium, tantalum or combinations thereof, for example titanium or tantalum. In examples, A can be aluminum, gallium, indium, thallium, silicon, germanium, tin, lead, sulphur, or combinations thereof, for example silicon.

For example, the electrode substrate can be selected from any of $Ti_2AlC$, $Nb_2AlC$, $Ti_2GeC$, $Zr_2SnC$, $Hf_2SnC$, $Ti_2SnC$, $Nb_2SnC$, $Zr_2PbC$, $Ti_2AlN$, $(Nb,Ti)_2AlC$, $Cr_2AlC$, $Ta_2AlC$, $V_2AlC$, $V_2PC$, $Nb_2PC$, $Nb_2PC$, $Ti_2PbC$, $Hf_2PbC$, $Ti_2AlN_{0.5}C_{0.5}$, $Zr_2SC$, $Ti_2SC$, $Nb_2SC$, $Hf_2Sc$, $Ti_2GaC$, $V_2GaC$ $Cr_2GaC$, $Nb_2GaC$, $Mo_2GaC$, $Ta_2GaC$, $Ti_2GaN$, $Cr_2GaN$, $V_2GaN$, $V_2GeC$, $V_2AsC$, $Nb_2AsC$, $Ti_2CdC$, $Sc_2InC$, $Ti_2InC$, $Zr_2InC$, $Nb_2InC$, $Hf_2InC$, $Ti_2InN$, $Zr_2InN$, $Hf_2InN$, $Hf_2SnN$, $Ti_2TIC$, $Zr_2TIC$, $Hf_2TIC$, $Zr_2TlN$, $Ti_3AlC_2$, $Ti_3GeC_2$, $Ti_3SiC_2$, $Ti_4AlN_3$ or combinations thereof. In examples, the electrode substrate can be any one of $Ti_3SiC_2$, $Ti_2AlC$, $Ti_2AlN$, $Cr_2AlC$, $Ti_3AlC_2$ or combinations thereof.

Methods of preparing such materials are known from "The Max Phases: Unique New Carbide and Nitride Materials", American Scientist, Volume 89, p. 334-343, 2001.

It has been found that the electrodes, when used in the process, are highly selective for hydrogen evolution. Because of their selectivity their use as a cathode, in the process for production of chlorate, eliminates the need for the addition of sodium dichromate to the electrolyte.

The substrate used in the electrodes is typically titanium, or more preferred titanium with an intermediate layer of titanium suboxide, such as the substrates described in WO2017050873.

The configuration of the electrode substrate may, for example, take the form of a flat sheet or plate, a curved surface, a convoluted surface, a punched plate, a woven wire screen, an expanded mesh sheet, a rod, or a tube. Planar shapes, e.g. sheet, mesh or plate are preferred.

The substrate may be usefully pre-treated for enhanced adhesion by any method known in the art, for example; chemical etching and/or blasting.

The electrode is provided with an electrocatalytic top layer comprising at least one of cerium- and manganese oxide. This top layer provides the selectivity that eliminates the need for the addition to chromium to the electrolyte. The cerium and/or manganese oxide are typically in their +4 oxidation state.

The top layer may be provided by various methods known in the art. There are several processes to synthesize cerium oxide and/or manganese oxide. The most typically used methods in scientific works are hydrothermal, sol-gel, microwave, homogenous precipitation electrodeposition, and thermal decomposition.

Good results were obtained when the top coating was applied by thermal decomposition. For thermal decomposition, the electrode substrate can be treated with a precursor solution (e.g. a solution of $Mn(NO_3)_2$ or $Ce(NO_3)_3$) in a suitable solvent (e.g. ethanol) at a suitable concentration (e.g. between about 0.1-about 1 M). The precursor solution may be applied by any suitable technique, for example by using a brush to apply a homogeneous layer. After the precursor solution has been applied the coated substrate is dried and subjected to a calcination process. The calcination process is responsible for the decomposition of the precursor to form cerium- and/or manganese oxide. The calcination process may be carried out at a suitable "annealing" temperature, anywhere between about 200 and about 800° C. Preferred annealing temperatures for the heat treatment are between about 250 and about 500° C., more preferred between about 400 and about 500° C.

The process can be repeated by applying multiple layers, until an acceptable surface coverage has been reached. The surface coverage of the electrocatalytic layer is typically in the range of between about 0.1 and about 4.0 mg/cm$^2$.

The electro-catalytic layer typically has a cerium or manganese content in an amount of between about 0.1-about 4 mg/cm$^2$, typically about 1-about 4 mg/cm$^2$ or even more typically about 1-about 3 mg/cm$^2$.

In the non-divided electrolytic cell, the electrolyte solution usually contains alkali metal chlorate in addition to the chloride. During the electrolysis the solution is enriched in chlorate. Process conditions and concentrations are known in the art, for example such as disclosed in WO2010130546.

With "free of added chromium" is meant that no chromium is specifically added to the process as a separate additional constituent in a predetermined quantity. However, low levels of chromium may be present in the electrolyte, even though this is not necessary, because chromium may be present in low levels in other commercially available electrolyte constituents, such as salt, acid, caustic, chlorate or other "chemical" electrolyte additives.

EXAMPLES

Example 1: Electrode Preparation and Characterization

In typical preparations of electrodes for example 2, described hereafter, titanium substrates were cleaned and subsequently etched in boiling 1:1 mixture of 37% hydrochloric acid and deionized water for 20 minutes. The electrodes were rinsed with an excess amount of deionized water and ethanol and were dried by air. V≈50 μl of 1M ethanol-based solution of Mn(NO3)2 or Ce(NO3)2 was spread homogeneously using a short-haired brush. The electrodes were dried at T1=60° C. for 10 minutes and subsequently annealed at T2=200-500° C. for 10 minutes in air atmosphere. The catalyst loading of the different electrodes shown in example 2 was controlled by the repetition of this coating cycle. After casting the last layer of the coating, the electrodes were annealed at T2 for an extra 60 minutes.

Electrode Characterization: XRD (FIG. 1) measurements were performed to verify the phase composition of the manganese oxides formed from a $Mn(NO_3)_2$ precursor at different annealing temperatures. The electrocatalytic top layer formed at T2=200° C. can be identified as mostly $Mn_2O_3$ with β-$MnO_2$ minority, based on the XRD measurement (FIG. 1). At higher annealing temperatures the $Mn_2O_3$ phase is still present, but the β-$MnO_2$ phase becomes dominant. The XRD patterns recorded for the two highest annealing temperatures are very similar, indicating a similar phase composition for these cases.

Figure 2:
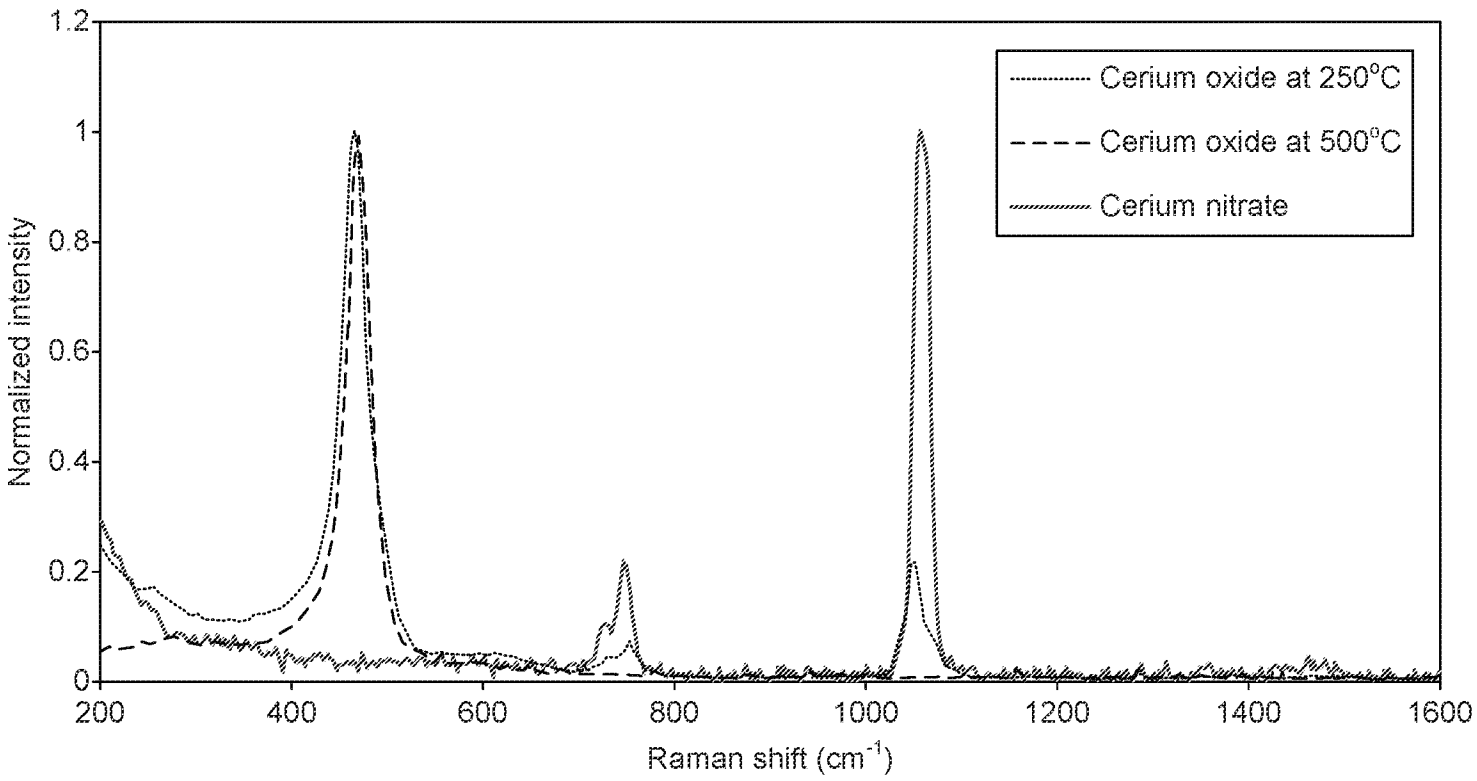
FIG. 2. is a Raman spectra of cerium oxide development from cerium nitrate at different annealing temperatures.

Raman analysis was used to verify the phase composition of the top layer comprising cerium oxides. FIG. 2 show the spectra taken of the samples formed at 250° C. respectively 500° C. show that both layers mostly consist of $CeO_2$ ($Ce^{+4}$ oxidation state). Some Ce-nitrate residues can be seen in the 250° C. samples.

Example 2: Current Efficiency Measurements

The selectivity towards HER was determined as Cathodic Current Efficiency, CCE(%), by analysis of gases evolved from an electrochemical set-up. The current efficiency measurements were performed in a custom-designed electrochemical setup. It consisted of a sealed, jacketed cell which had two openings on a tightly fitting lid—an inlet for the continuous Ar gas purging and an outlet connected to a mass spectrometer through a silica gel filled gas drying column. The pH of the solution was regulated using NaOH and HCl solutions. The temperature of the electrolyte was controlled by circulating water from an external heater bath in the jacket of the cell. The $H_2$ production-rate and the Faradaic efficiency values were calculated from the composition of the cell gas outlet. UV-vis spectroscopy was used to determine the hypochlorite concentration of the solutions. For the analysis, 200 μl liquid aliquots were taken, and immediately added to 0.5 M NaOH. The hypochlorite concentration was calculated from the absorbance maximum at λ=292 nm, (ε292 nm=350 dm$^3$ mol$^{-1}$ cm$^{-1}$).

The evolved hydrogen (c.f. reaction 1) is compared with the theoretical amount of hydrogen that can be formed at a certain current density. In the presence of hypochlorite any other reaction not producing hydrogen is seen as a loss according to reaction 7.

The selectivity of an electrode with a top layer produced from $Ce(NO_3)_2$ at different annealing temperatures is reflected in Table 1.

TABLE I

Cathodic current efficiency electrode with a top layer produced from $Ce(NO_3)_2$.

| CeOx | | CCE % | | |
|---|---|---|---|---|
| loading/ mg cm$^{-2}$ | Annealing T/° C. | j = 100 mA cm$^{-2}$ | j = 200 mA cm$^{-2}$ | j = 300 mA cm$^{-2}$ |
| 1.2 | 250 | 87.61 | 89.42 | 88.19 |
| 2.3 | 250 | 84.14 | 83.54 | 85.45 |
| 2.1 | 500 | 93.45 | 92.90 | 89.34 |
| 0 | — | 39.78 | 67.84 | 82.40 |

Electrolyte parameters: pH = 6.5, 80 mM NaClO + 2M NaCl solution, room temperature, Ti substrate The selectivity of an electrode with a top layer produced from on $Mn(NO_3)_2$ at different annealing temperatures is reflected in Table 2.

TABLE II

Cathodic current efficiency electrode with a top layer produced from on $Mn(NO_3)_2$;

| Annealing temperature, 200° C. | | Annealing temperature, 300° C. | | Annealing temperature, 400° C. | | Annealing temperature, 500° C. | |
|---|---|---|---|---|---|---|---|
| Catalyst (MnOx) loading, mg cm$^{-2}$ | CCE, % | Catalyst (MnOx) loading, mg cm$^{-2}$ | CCE, % | Catalyst (MnOx) loading, mg cm$^{-2}$ | CCE, % | Catalyst (MnOx) loading, mg cm$^{-2}$ | CCE, % |
| 0 | — | 0 | — | 0 | 82.4 | 0 | 82.4 |
| 0.15 | — | 0.15 | — | 0.15 | 84.7 | 0.15 | 86.7 |
| 0.45 | — | 0.45 | — | 0.45 | 87.4 | 0.45 | 90.7 |
| 0.75 | — | 0.75 | — | 0.75 | 91.8 | 0.75 | 92.4 |
| 1.5 | 88.7 | 1.5 | 92.1 | 1.5 | 95.7 | 1.5 | 93.4 |
| 2.25 | — | 2.25 | — | 2.25 | 93.4 | 2.25 | 94.5 |
| 3 | — | 3 | — | 3 | 91.8 | 3 | 94.9 |
| 3.75 | — | 3.75 | — | 3.75 | 92.4 | — | — |

Electrolyte parameters: pH = 6.5, 80 mM NaClO + 2M NaCl solution, room temperature, Ti substrate, j = 300 mA cm-2

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the various embodiments in any way. Rather, the foregoing detailed description will provide those skilled in the art with a convenient road map for implementing an exemplary embodiment as contemplated herein. It being understood that various changes may be made in the function and arrangement of elements described in an exemplary embodiment without departing from the scope of the various embodiments as set forth in the appended claims.

What is claimed is:

1. A process for producing alkali metal chlorate, comprising introducing an electrolyte solution, free of added chromium, said solution comprising alkali metal chloride to a non-divided electrolytic cell comprising at least one anode and at least one cathode, and electrolyzing the electrolyte solution to produce an electrolyzed solution enriched in chlorate, wherein at least one cathode comprises a conductive electrode substrate which may be coated with one or more intermediate conductive layers, and an electrocatalytic top layer applied onto said substrate or onto intermediate layers, said top layer comprising cerium oxide and/or manganese oxide.

2. A process according to claim 1, in which the one or more intermediate layers comprising at least one of titanium suboxide, titanium nitride (TiNX), MAX phase, silicon carbide, titanium carbide, titanium aluminium carbide, titanium silicon carbide, graphite, glassy carbon or mixtures thereof.

3. A process according to claim 1, wherein the top layer comprises cerium and/or manganese oxide in their +4 oxidation state.

4. A process according to claim 1, wherein the conductive substrate is titanium, or titanium provided with a layer of titanium suboxide.

5. A process according to claim 1, wherein electrocatalytic layer is deposited by thermal decomposition.

6. A process according to claim 1, wherein the electrodeposited layer is deposited by thermal decomposition and heat treated between about 400 and about 500° C.

7. A process according to claim 1, wherein the surface coverage of the electrocatalytic layer is in the range of between about 0.1 and about 4.0 mg/cm$^2$.

8. A process according claim 1, wherein the electrocatalytic layer provides a cerium and/or manganese content in an amount of between about 1 and about 3 mg/cm$^2$.

9. A process according to claim 2, wherein the top layer comprises cerium and/or manganese oxide in their +4 oxidation state.

10. A process according to claim 9, wherein the conductive substrate is titanium, or titanium provided with a layer of titanium suboxide.

11. A process according to claim 10, wherein electrocatalytic layer is deposited by thermal decomposition.

12. A process according to claim 11, wherein the electrodeposited layer is deposited by thermal decomposition and heat treated between about 400 and about 500° C.

13. A process according to claim 12, wherein the surface coverage of the electrocatalytic layer is in the range of between about 0.1 and about 4.0 mg/cm$^2$.

14. A process according claim 13, wherein the electrocatalytic layer provides a cerium and/or manganese content in an amount of between about 1 and about 3 mg/cm$^2$.

15. A process according to claim 3, wherein the conductive substrate is titanium, or titanium provided with a layer of titanium suboxide;

wherein electrocatalytic layer is deposited by thermal decomposition;

wherein the electrodeposited layer is deposited by thermal decomposition and heat treated between about 400 and about 500° C.; and wherein the surface coverage of the electrocatalytic layer is in the range of between about 0.1 and about 4.0 mg/cm$^2$.

16. A process for producing alkali metal chlorate, comprising introducing an electrolyte solution, free of added chromium, said solution comprising alkali metal chloride to a non-divided electrolytic cell comprising at least one anode and at least one cathode, and electrolyzing the electrolyte solution to produce an electrolyzed solution enriched in chlorate, wherein at least one cathode comprises a titanium substrate which may be coated with one or more intermediate conductive layers, and an electrocatalytic top layer applied onto said substrate or onto intermediate layers, said electrocatalytic top layer comprising $Mn_2O_3$, $\beta$-$MnO_2$, and/or $CeO_2$.

17. The process of claim 16 wherein the top layer comprises $Mn_2O_3$ and $\beta$-$MnO_2$.

18. The process of claim 17 wherein the at least one cathode is free of the intermediate conductive layer, wherein the electrodeposited layer is deposited by thermal decomposition and heat treated between about 400 and about 500° C., and wherein the electrocatalytic layer provides a cerium and/or manganese content in an amount of from about 1 to about 3 mg/cm$^2$.

19. The process of claim 16 wherein the top layer comprises $CeO_2$.

20. The process of claim 19 wherein the at least one cathode is free of the intermediate conductive layer, wherein the electrodeposited layer is deposited by thermal decomposition and heat treated between about 400 and about 500° C., and wherein the electrocatalytic layer provides a cerium and/or manganese content in an amount of from about 1 to about 3 mg/cm$^2$.

* * * * *